US007196481B2

(12) United States Patent
Bushell et al.

(10) Patent No.: US 7,196,481 B2
(45) Date of Patent: Mar. 27, 2007

(54) METHOD AND DRIVE CIRCUIT FOR CONTROLLING LEDS

(75) Inventors: Timothy George Bushell, Cumbria (GB); Christopher Brian Taylor Latham, Cumbria (GB)

(73) Assignee: Oxley Developments Company Limited, Cumbria (GB)

( * ) Notice: Subject to any disclaimer, the term of this patent is extended or adjusted under 35 U.S.C. 154(b) by 0 days.

(21) Appl. No.: 10/954,377

(22) Filed: Sep. 29, 2004

(65) Prior Publication Data

US 2005/0104541 A1 May 19, 2005

(51) Int. Cl.
*H05B 37/02* (2006.01)

(52) U.S. Cl. ..... 315/291; 315/307; 315/224

(58) Field of Classification Search ..... 315/312, 315/291, 307

See application file for complete search history.

(56) References Cited

U.S. PATENT DOCUMENTS 5,406,172 A 4/1995 Bennett
5,625,616 A * 4/1997 Koike et al. ..... 369/53.26
5,694,208 A * 12/1997 Ichikawa ..... 356/73
5,783,909 A * 7/1998 Hochstein ..... 315/159
6,111,739 A * 8/2000 Wu et al. ..... 361/106
6,400,101 B1 * 6/2002 Biebl et al. ..... 315/291
6,614,358 B1 9/2003 Hutchison et al.
6,870,325 B2 * 3/2005 Bushell et al. ..... 315/224

FOREIGN PATENT DOCUMENTS

EP 0 733 894 A2 * 9/1996
EP 1 339 263 A1 8/2003
WO 99/56303 * 11/1999

* cited by examiner

*Primary Examiner*—Trinh Vo Dinh
(74) *Attorney, Agent, or Firm*—Blakeley, Sokoloff, Taylor & Zafman; Stephen M. De Klerk

(57) ABSTRACT

A method and control circuit are disclosed for controlling light emitting diodes ("LEDs"). Based upon the LED's current versus intensity characteristic and temperature versus intensity characteristic, the rate of change of LED output intensity with respect to current is calculated. Adjusting LED current to provide zero rate of change ensures that LED output is maximised.

12 Claims, 1 Drawing Sheet

METHOD AND DRIVE CIRCUIT FOR CONTROLLING LEDS

CROSS REFERENCE TO OTHER APPLICATIONS

The present patent application claims priority from United Kingdom Patent Application No. 0322823.6, filed on Sep. 30, 2003.

BACKGROUND OF THE INVENTION

The present invention is concerned with control of light emitting diodes ("LEDs").

The present invention has been developed in response to requirements for aircraft lighting utilising light emitting diodes (LEDs) although it has numerous potential applications in connection with lighting for other purposes. LEDs offer great advantages over more traditional light sources such as filament bulbs. LEDs have a much longer service life than such traditional sources, are more energy efficient and can be chosen to emit only, or largely, in selected frequency ranges. It is known to utilise a bank of LEDs to substitute for a filament bulb e.g. in traffic lights or in external aircraft lighting. Lamps suitable for such purposes are disclosed, for example, in published French patent application FR2586844 (Sofrela S.A.), utilising a PCB bearing a bank of LEDs which together provide the luminous intensity required to replace the filament of a traditional bulb.

It is very well known that a circuit for driving LEDs should incorporate some means for limiting the current passing through them. The resistance of an LED varies with temperature and if no limit is imposed on the current passing through it, the result can be excessive power being dissipated in the LED with consequent damage to it. The simplest current limiter is a resistor in series with the LED. An alternative is to drive the LED (or LEDs) using a constant current source.

A more sophisticated mode of control of LEDs is desirable in certain contexts, aircraft lighting being one example. The lights used at the exterior of an aircraft-navigation lights, landing lights etc.—are required to provide a high level of output optical power and to do so despite large variations in ambient temperature. A simple current control device cannot provide optimal LED performance in this demanding environment.

The use of a microprocessor to control an LED has been proposed in European patent application EP0516398 (Mitsubishi Kasei Corporation). However the intention was to provide a highly stable emission spectrum to serve as a "standard light source", microprocessor control being used to effect closed loop stabilisation of output wavelength.

SUMMARY OF THE INVENTION

There is a further aspect to the present invention, addressed to a separate problem, as will now be explained.

As the temperature of the LEDs decreases their forward voltage increases. If the LEDs need to operate over a wide temperature range then a high enough voltage must be provided to drive them even at the coldest temperature. At the highest temperature the LED forward voltage is very low and up to a third of the heat generated may come from the drive circuitry rather than the LEDs. This makes the LED very inefficient as light output decreases with increasing temperature.

In various applications, LED lights are intended to flash. Certain lights used at the exterior of an aircraft, for example, are flashed on and off at low frequency.

In accordance with a third aspect of the present invention there is a method of controlling a flashing light, comprising controlling the light's duty cycle in response to temperature.

The temperature of most direct relevance in this regard is the light's operating temperature. However ambient temperature has an effect on operating temperature and the duty cycle may be controlled in response to ambient temperature.

The relationship between temperature and duty cycle need not be direct. Where LED current is actively controlled (as in the first and second aspects of the present invention) the control of duty cycle may be linked to control of LED current. In the most preferred embodiment, the duty cycle is increased when LED current is limited by the available voltage and is decreased when LED current is not limited by the available voltage. These conditions are influenced by ambient temperature.

The duty cycle is preferably limited by a visually acceptable maximum and minimum.

In accordance with the fourth aspect of the present invention there is a circuit for driving flashing LED light, the circuit comprising an electronic controller which controls the duty cycle of the flashing light in response to temperature.

In accordance with a first aspect of the present invention there is a method of controlling current through at least one light emitting diode ("LED") comprising calculating the rate of change of LED output intensity with current, based upon (1) the LED's current versus intensity characteristic and (2) the LED's temperature versus intensity characteristic and the rate of LED temperature change with current and adjusting LED current to achieve zero rate of change of LED output intensity with current, thereby maximising LED output intensity.

Preferably the method further comprises calculating the rate of LED temperature change with respect to LED current based upon (a) the rate of change of LED input power with respect to current, calculated from the LED forward voltage, and (b) the rate of change of heat dissipated by the LED with respect to temperature, calculated from the thermal resistance between the LED and its surroundings.

In accordance with a second aspect of the present invention there is an LED drive circuit for controlling current through at least one LED, the circuit comprising an electronic controller provided with the LED's current versus intensity characteristic and the LED's temperature versus intensity characteristic, the controller being adapted to adjust the LED current, based upon the two LED characteristics, to maximise LED output intensity.

Preferably, the controller is arranged to calculate rate of change of LED output intensity with current based upon the two LED characteristics and to adjust current to a level at which this rate of change is zero.

The drive circuit preferably further comprises an ambient temperature sensor whose output is led to the electronic controller.

The controller may be adapted to obtain a thermal resistance between the LED and its surroundings based upon the ambient temperature output from the sensor.

The electronic controller is preferably adapted to obtain a rate of change of LED temperature with LED current taking account of thermal resistance between the LED and its surroundings.

Preferably the electronic controller is arranged to monitor LED voltage and to obtain a rate of change of LED temperature based upon the assumption that a change in LED input power is accompanied by an equal change in heat dissipated by the LED.

DETAILED DESCRIPTION OF THE INVENTION

Figure 1:
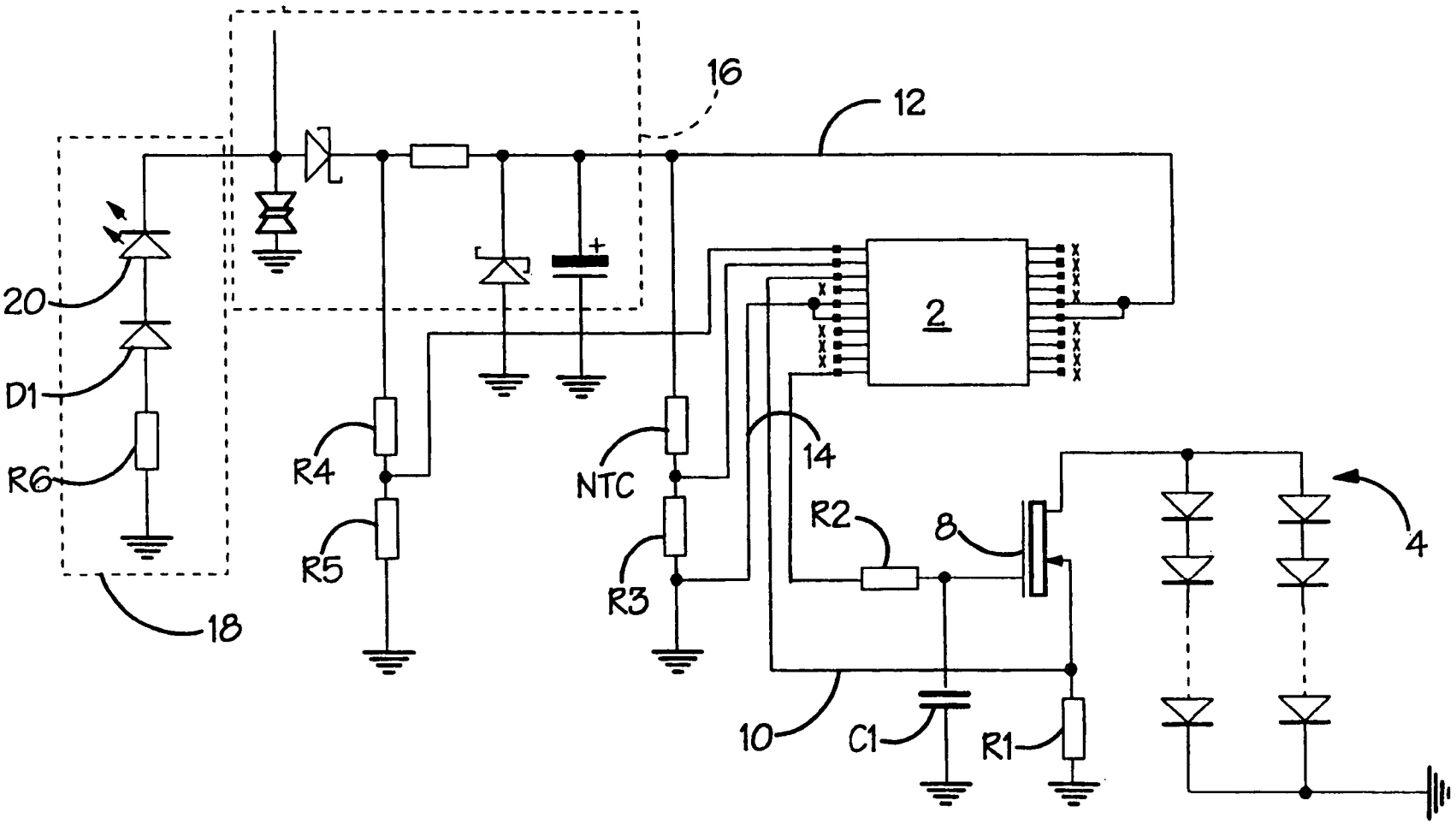
FIG. 1 is a circuit diagram of an LED driving circuit employing the invention.

A specific embodiment of the present invention will now be described, by way of example only, with reference to the accompanying drawing which is a circuit diagram of an LED drive circuit suitable for implementing the present invention.

The illustrated circuit uses a pre-programmed electronic control unit (ECU) 2 which receives inputs relating to aspects of LED function and in response controls LED current.

In the illustrated circuit supply to a series/parallel array 4 of LEDs is taken from the drain of a MOSFET 8 whose source is connected via a resistor R1 to ground. Hence the LEDs 4 are connected in series with the MOSFET. The gate of the MOSFET is connected via a resistor R2 to an output of the ECU 2. In addition a smoothing capacitor C1 is connected between the gate and the ECU output. In operation, the ECU's output takes the form of a pulse width modulated (PWM) square wave signal. The smoothing capacitor C1 and associated resistor R2 smooth the signal and thereby provide to the gate of the MOSFET a D.C. voltage. By adjusting the PWM signal the ECU 2 can vary this voltage and in turn the MOSFET, in response to the gate voltage, controls current through the LEDs. The ECU can thus control LED current and it does so in response to inputs from two sources.

The resistor R1 connected in series with the MOSFET, or more specifically between the MOSFET and ground, serves as a current sensing resistor. The potential at the side of this resistor remote from ground is proportional to the current through the LEDs and a line 10 connects this point to an input of the ECU 2.

The second input in this exemplary embodiment of the invention is derived from a temperature sensor NTC connected in a potential divider configuration:

one side of the sensor NTC is led to high rail 12 while the other side is led via a resistor R3 to ground. Hence a voltage signal representative of the sensed temperature is applied to an input of the ECU through a line 14 connecting the input to a point between sensor NTC and resistor R3. The ECU also receives a reference voltage, through still a further input, from potential divider R4, R5.

Dotted box 16 in the drawing contains components relating to the smoothing and spike protection of the electrical supply. A further dotted box 18 contains components relating to an optional infra red LED source, comprising IR LED 20 and a series resistor R6 and diode D1.

The ECU 2 of the illustrated embodiment is a programmable integrated circuit device of a type well known in itself and provides great flexibility in the control of the LEDs. The ECU is programmed to maximise light output from the LEDs over a range of weather/temperature conditions. This is done by adjusting LED current.

For a given current increase, at constant LED junction temperature, a certain increase in LED light output results. This increase can be found from the LED's current versus light intensity characteristic, which is typically found in the manufacturer's data sheets and so is easily available. The ECU 2 carries a representation of this characteristic in its memory. However in practice an increase in LED current causes an increase in dissipated power and hence in LED junction temperature, tending to reduce LED light output. The fall in light output for a given increase in temperature can be found from the LED's temperature versus intensity characteristic, which again is typically available in the manufacturer's data sheet and is stored by the ECU 2.

If LED light output intensity is regarded as a function of LED current, it has a maximum where the rate of change of intensity with current is to zero, or equivalently where Intensity rise per mA (constant temperature)=Intensity fall per mA (due to change in junction temperature)

However to determine the quantity on the right hand side of this expression based upon the LED's temperature versus intensity characteristic, it is necessary to calculate the rise in LED junction temperature for a given change in current, so that the condition can be written as:

Intensity rise per mA (constant temperature)=(Intensity fall per C)×(Temperature rise, C per mA)

However the temperature rise per mA can only be determined by knowing the thermal resistance of the LED to ambient (in C/W). For a stable indoor system this quantity can be regarded as being a constant, obtainable by measurement or calculation, and the optimum current can be calculated accordingly. In other systems, particularly the example of aircraft lighting discussed above, the thermal resistance may vary due to temperature extremes, air flow etc. In the illustrated embodiment, in order to make allowance for such factors, ambient temperature is monitored enabling the thermal resistance between the LED junction and its surroundings to be calculated in real time.

The ECU 2 can calculate the change in input power to the LEDs for a given current change since the LED voltage and current are both known. If the assumption is made that this extra power is dissipated by conduction of heat away from the LED junction then the attendant temperature change is found by multiplying the change in power by the aforementioned resistance between the LEDs and their surroundings. In fact an appreciable proportion is dissipated by virtue of the LED's light output and a more sophisticated approach involves subtracting this heat loss from the heat going into heating of the LED.

Adjustments to LED current to achieve maximum brightness are carried out, based upon the above considerations, by an adaptive PID (proportional integral differential) algorithm. Such techniques are well known and will not be described herein.

Setting the LED current for maximum light output in this manner increases LED reliability, as compared with the normal alternative of setting the LED current to the maximum level at which the maximum LED junction temperature is not exceeded. Lowering current (in order to increase brightness) lowers the junction temperature and leads to improved reliability.

It is found that for an aircraft light, thermal resistance between the LEDs can vary greatly due to airflow, altitude, temperature extremes and weather as shown by the following examples.

| Resistance | Actual Current | Optimum current | Junction Temperature | Intensity Relative to Optimum |
|---|---|---|---|---|
| 2.6 C/W | 66 mA | 66 mA | 93 | 1.0 |
| 2.6 C/W | 100 mA | 66 mA | 125 | 0.85 |
| 0.6 C/W | 100 mA | 100 mA | 53 | 1.0 |

Consequently the use of an ambient temperature sensor, enabling determination of the thermal resistance, is highly advantageous in this situation.

What is claimed:

1. A method of controlling current through at least one light emitting diode ("LED") comprising calculating the rate of change of LED output intensity with current ("the calculated rate of change"), based upon (1) the LED's current versus intensity characteristic and (2) the LED's temperature versus intensity characteristic and the rate of LED temperature change with current, and implementing an adaptive algorithm to control LED current based upon the calculated rate of change, the algorithm serving, by controlling LED current, to bring the LEDs toward a condition in which the calculated rate of change is zero and LED output intensity is thereby maximized.

2. The method as claimed in claim 1 further comprising calculating the rate of LED temperature change with respect to LED current based upon (a) the rate of change of LED input power with respect to current, calculated from the LED forward voltage, and (b) the rate of change of heat dissipated by the LED with respect to temperature, calculated from the thermal resistance between the LED and its surroundings.

3. The method as claimed in claim 2 further comprising measuring an ambient temperature and obtaining the thermal resistance based upon the measured ambient temperature.

4. The method of claim 1 wherein a flashing light of the LED is controlled by controlling the light's duty cycle in response to temperature.

5. The method of claim 4 comprising controlling LED drive current in response to temperature, increasing the light's duty cycle when LED current is limited by the available voltage and decreasing the light's duty cycle otherwise.

6. The method as claimed in claim 1, in which the adaptive algorithm is a proportional integral differential algorithm.

7. An LED drive circuit for controlling current through at least one LED, the circuit comprising an electronic controller provided with the LED's current versus intensity characteristic and the LED's temperature versus intensity characteristic, the controller being adapted to calculate rate of change of LED output intensity with current ("the calculated rate of change") based upon said current versus intensity and temperature versus intensity characteristics of the LED, and to implement an adaptive algorithm which controls LED current based upon the calculated rate of change, to bring the LEDs toward a condition in which the calculated rate of change is zero and LED output is thereby maximized.

8. The LED drive circuit as claimed in claim 7 further comprising an ambient temperature sensor whose output is led to the electronic controller.

9. The LED drive circuit as claimed in claim 7 wherein the electronic controller is adapted to obtain a thermal resistance between the LED and its surroundings based upon the ambient temperature output from the sensor.

10. The LED drive circuit as claimed in claim 7 wherein the electronic controller is adapted to obtain a rate of change of LED temperature with LED current taking account of thermal resistance between the LED and its surroundings.

11. The LED drive circuit as claimed in claim 10 wherein the electronic controller is arranged to monitor LED voltage and to obtain a rate of change of LED temperature based upon the assumption that a change in LED input power is accompanied by an equal change in heat dissipated by the LED.

12. The circuit of claim 7 comprising an electronic controller which controls the duty cycle of the light in respect to temperature.

* * * * *

UNITED STATES PATENT AND TRADEMARK OFFICE

CERTIFICATE OF CORRECTION

PATENT NO. : 7,196,481 B2
APPLICATION NO. : 10/954377
DATED : March 27, 2007
INVENTOR(S) : Timothy George Bushell et al.

It is certified that error appears in the above-identified patent and that said Letters Patent is hereby corrected as shown below:

On the title page item [30], Foreign Application Priority Data, please add:

--Sept. 30, 2003 (GB).....0322823.6--

Signed and Sealed this

Thirtieth Day of September, 2008

JON W. DUDAS
*Director of the United States Patent and Trademark Office*